US006536388B2

(12) United States Patent
Lou

(10) Patent No.: US 6,536,388 B2
(45) Date of Patent: Mar. 25, 2003

(54) VARIABLE ENGINE VALVE CONTROL SYSTEM

(75) Inventor: Zheng Lou, Plymouth, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/742,199

(22) Filed: Dec. 20, 2000

(65) Prior Publication Data

US 2002/0073946 A1 Jun. 20, 2002

(51) Int. Cl.[7] ..... F01L 9/02

(52) U.S. Cl. ..... 123/90.12; 123/90.13; 123/90.14

(58) Field of Search ..... 123/90.12, 90.13, 123/90.14

(56) References Cited

U.S. PATENT DOCUMENTS

| | | | | |
|---|---|---|---|---|
| 2,398,997 A | | 4/1946 | Berry et al. | |
| 2,658,484 A | | 11/1953 | Kenny | |
| 2,667,155 A | * | 1/1954 | Paluch | 123/189 |
| 2,831,464 A | | 4/1958 | Lillquist | |
| 3,156,157 A | | 11/1964 | Smith et al. | |
| 4,000,756 A | | 1/1977 | Ule et al. | |
| 4,106,586 A | | 8/1978 | Stafford | |
| 4,186,649 A | | 2/1980 | Sundstrom | |
| 4,450,928 A | | 5/1984 | Weber et al. | |
| 4,930,464 A | | 6/1990 | Letsche | |
| 5,275,136 A | | 1/1994 | Schechter et al. | |
| 5,287,829 A | | 2/1994 | Rose | |
| 5,451,029 A | * | 9/1995 | Kruger | 123/90.12 |
| 5,572,961 A | | 11/1996 | Schechter et al. | |
| 5,603,305 A | | 2/1997 | Miyake et al. | |
| 5,682,846 A | * | 11/1997 | Scharnweber | 123/90.12 |
| 5,713,315 A | | 2/1998 | Jyoutaki et al. | |
| 5,970,956 A | * | 10/1999 | Sturman | 123/508 |
| 6,135,073 A | * | 10/2000 | Feucht et al. | 123/90.12 |

FOREIGN PATENT DOCUMENTS

| | | |
|---|---|---|
| DE | 3833-459 | 4/1990 |
| GB | 982003 | 6/1965 |
| JP | 59-180142 | 10/1984 |
| JP | 61-109905 | 5/1986 |

OTHER PUBLICATIONS

U.S. application Ser. No. 09/742,200 for Variable Engine Valve Control System: filed Dec. 20, 2000, Lou, Z.

* cited by examiner

*Primary Examiner*—Thomas Denion
*Assistant Examiner*—Jaime Corrigan
(74) *Attorney, Agent, or Firm*—Brinks Hofer Gilson & Lione

(57) ABSTRACT

A valve control system for an internal combustion engine includes a housing comprising a cylinder defining a longitudinal axis, an exhaust port, a piston disposed in the cylinder and an engine valve operably connected to the piston. An exhaust member is disposed in the housing and is variably moveable along a longitudinal path to a desired position between a maximum and minimum lift position. The exhaust member has an exhaust port that is maintained in communication with the housing exhaust port as the exhaust member is selectively, variably moved between the maximum and minimum lift positions. A pressure source selectively applies a pressure to the piston and a control system is operably connected to the exhaust member and selectively, variably moves the exhaust member between the maximum and minimum position. A method for controlling the engine valve is also provided.

35 Claims, 6 Drawing Sheets

7
8
Ps
4
18
16
20
22
Pexh
42
44
64
24
68
70
54
66
78
P3
56
P1
40
46
50
36
34
38
P2
30
58
48
52
32

250
252
254
256
258
80
84

240
242
246
244
248
80
84

34
230
80
84

34
210
222
214
216
212
218
220
224
84
80

VARIABLE ENGINE VALVE CONTROL SYSTEM

BACKGROUND

The present invention relates generally to a variable engine valve control system, and in particular, to engine valve control system providing variable timing and either continuously or discretely variable lift.

In general, various throttle-less systems can be used to actively control engine valves through the use of variable lift and/or variable timing so as to achieve various improvements in engine performance, fuel economy, reduced emissions, and other like aspects. Typically, such systems are mechanical VVLT (variable valve-lift and timing), electrohydraulic VVLT, or electro/mechanical VVT (variable valve-timing). In general, mechanical VVLT systems are cam-based systems, which may have additional phasers, cams and linkage. One important limitation of such mechanical VVLT systems is that the timing and lift variations are not independent. Electro/mechanical VVT systems generally replace the cam in the mechanical VVLT system with an electro-mechanical actuator. However, such systems do not provide for variable lift.

In contrast, an electrohydraulic VVLT system is controlled by electrohydraulic valves, and can generally achieve independent timing and lift controls so as to thereby provide greater control capability and power density. However, typical electrohydraulic VVLT systems are generally rather complex, can be expensive to manufacture, and typically are not as reliable or robust as mechanical systems due to their relative complexity.

BRIEF SUMMARY

Briefly stated, in one aspect of the invention, one preferred embodiment of a valve control system for an internal combustion engine includes a housing comprising a cylinder defining a longitudinal axis, and an exhaust port. A piston is disposed in the cylinder and is moveable along the longitudinal axis in a first and second direction. The piston has a first and second side. An engine valve is operably connected to the first side of the piston. An exhaust member is disposed in the housing and is variably moveable along a longitudinal path to a desired position between a maximum and minimum lift position. The exhaust member has an exhaust port that is maintained in communication with the housing exhaust port as the exhaust member is selectively, variably moved between the maximum and minimum lift positions. A pressure source applies a pressure to the second side of the piston as the piston is moved in the first direction. A control system is operably connected to exhaust member and selectively, variably moves the exhaust member to a desired position between the maximum and minimum position. The piston is moveable along the longitudinal axis in the first direction to a lift position wherein the piston blocks the exhaust member exhaust port. Preferably, the exhaust member is continuously variably moveable, meaning it is moveable between an infinite number of positions, such that the control system provides continuously variable lift control. In one preferred embodiment, the exhaust member comprises a sleeve member, while in alternative preferred embodiment, the exhaust member comprises a wedge member.

In yet another alternative preferred embodiment, the exhaust member comprises an exhaust piston. Preferably, the exhaust piston selectively communicates with a plurality of secondary exhaust ports communicating with the cylinder. In such an embodiment, the valve control system provides discrete variable lift control.

In another aspect, a preferred method for controlling an engine valve in an internal combustion engine comprises applying a force to the exhaust member with the control system, moving the exhaust member along a longitudinal path in response to the application of the force thereto, maintaining communication between the exhaust member exhaust port and the housing exhaust port, applying a pressure to the second side of the piston and thereby moving the piston and the engine valve, and blocking the exhaust member exhaust port with the piston.

The present inventions provide significant advantages over other valve control systems, and methods for controlling valve engines. For example, each of the present embodiments of the valve control system is configured as either an electrohydraulic DLVT (discrete lift, variable timing) system, which achieves discrete variable lift and variable timing for engine valves, or an electrohydraulic VVLT system, which achieves continuous variable lift and variable timing for the engine valves. In any of the preferred embodiments, relatively simple hydraulic valves can be used, which eliminates the need for position sensing and feedback controls in the system and thereby substantially reduces the complexity and cost of the system. In this way, the systems are made simpler, less expensive and more robust than conventional electrohydraulic VVLT systems. Indeed, the preferred embodiments employ relatively simple mechanisms to control the engine valve lift, and thereby de-couple the lift control operation (the slow time response part) from the timing control operation (the fast time response part). Finally, even the discrete variable lift embodiment can closely match the performance of conventional VVLT systems, under most operating conditions, by providing a plurality of discrete variable lift positions within the system.

DETAILED DESCRIPTION OF THE PRESENTLY PREFERRED EMBODIMENTS

The term "variable" as used herein means capable of changing. As used herein, the term "discrete" means controlled in steps, e.g., not infinitely variable. The term "continuously" as used herein means infinitely, or having the property that the absolute value of the numerical difference between the value at a given point and the value at any point in a neighborhood of the given point can be made as close to zero as desired by choosing the neighborhood small enough, e.g., infinitely variable. The term "longitudinal" as used herein means of or relating to length or the lengthwise dimension. The term "plurality" as used herein means two or more.

Figure 1:
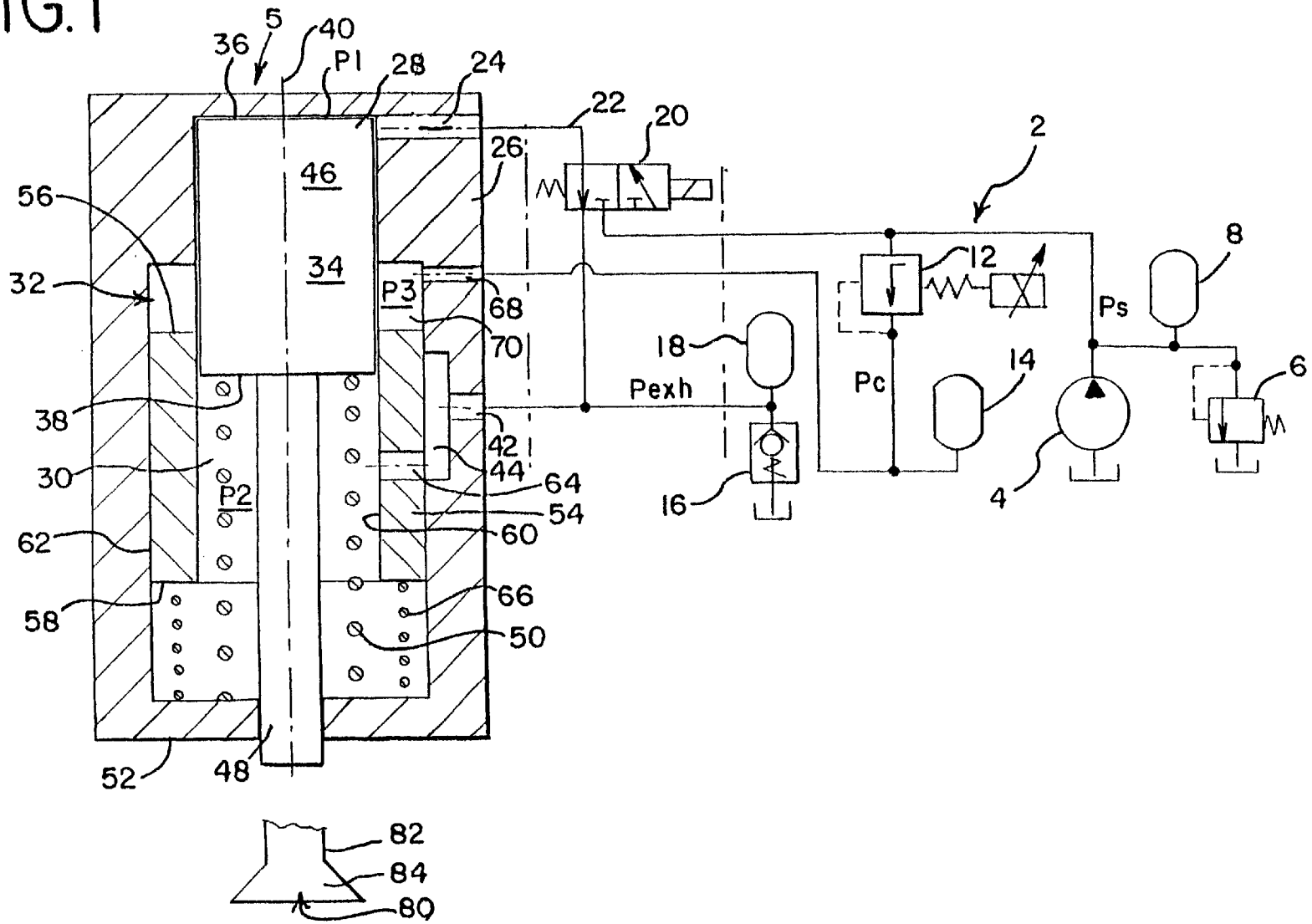
FIG. 1 is a schematic illustration of a preferred embodiment of the engine valve control system.

Referring to FIG. 1, an exemplary hydraulic circuit 2 is shown as including a hydraulic pump 4, a pressure regulator valve 6, including for example a pressure relief valve, and an accumulator 8. The circuit provides a system pressure Ps. It should be understood that the pump 4 can be a variable-displacement pump, which conserves energy. In an alternative configuration, the pressure relief valve may be replaced by an electrohydraulic pressure regulator to provide variable system pressure, if necessary and/or desired. Moreover, one of skill in the art will understand that the accumulator 10 may be eliminated if the total system has a proper flow balance and/or capacitance and compliance. The capacitance for example can be augmented by a reservoir. The hydraulic supply circuit is capable of supplying hydraulic pressure for the entire engine, if desired. Of course, one of skill in the art will understand that other hydraulic circuits would also work.

In one preferred embodiment, the hydraulic circuit 2 further includes an electrohydraulic pressure regulator 12, with or without an accumulator 14, which provides a control pressure Pc. The circuit may include two separate pressure regulators (second one not shown) to provide different control pressures for intake and exhaust engine valves respectively.

A spring-loaded check valve 16, shown with an accumulator 18, is operably connected to an exhaust port formed in a housing 26. The check valve controls the back pressure Pexh exerted during the return cycle of the engine valve. The back pressure serves to back-fill, without cavitation and/or over-retardation, a bottom side 38 of a piston 34 during the return stroke. One of skill in the art will understand that other commonly available engineering means can also be employed to control the back flow and pressure. The accumulator 18 can be dispensed with depending on the overall flow balance and system capacitance and compliance.

Again referring to FIG. 1, an electrohydraulic valve 20 is operably connected to an inlet line 22 feeding an inlet port 24 formed in the housing 26 and communicating with an upper portion 28 of a cylinder 32 adjacent a top side 36 of the piston 34. The electrohydraulic valve 20 is preferably configured as a 3-way, 2-position, normally-off, on/off solenoid valve. Of course, one of skill in the art will understand that other types of electrohydraulic valves can be used to achieve the same function, including for example a 3-way, 2-position, normally-on (open), on/off solenoid valve and/or a 4-way solenoid valve.

In general, there is usually one hydraulic actuator 5 associated with each engine valve 80. For example, an engine combustion cylinder having two engine intake valves and two engine exhaust valves (not shown) will have only two on/off valves, with one of the valves connected to or communicating with the pair of engine intake valves and the other connected to or communicating with the pair of engine exhaust valves. If there is a need for independent intake and exhaust lift control, the engine will then need two separate control pressure regulating valves 12. However, one pump 4 supplying one system pressure should be sufficient for both controls. If desired, the hydraulic actuator 5 can be sized differently for engine intake and exhaust valve applications. For example, in a fully-controlled 16-valve, 4-cylinder engine, the system may consist of one hydraulic pump 4, two control pressure regulating valves 12, eight on/off electrohydraulic valves 20, and 16 hydraulic actuators 5. If only the engine intake valves or the engine exhaust valves are to be controlled respectively, the system then preferably consists of one hydraulic pump 4, one control pressure regulating valve 12, four on/off valves 20, and eight hydraulic actuators 5. In alternative embodiments, one hydraulic actuator can be used to drive two engine intake valves or two engine exhaust valves on a single engine combustion cylinder.

Referring to FIG. 1, the housing 26 defines the cylinder 32, which has an upper portion 28 with an inner diameter and a lower portion 30 with an inner diameter, where the inner diameter of the lower portion 30 is greater than the inner diameter of the upper portion 28. The housing 26 is preferably formed as part of a cylinder head in an internal combustion engine, although it can be formed separately therefrom. The cylinder 32 defines a longitudinal axis 40. An exhaust port 42 communicates with the lower portion of the cylinder. The exhaust port 42 includes a longitudinally extending interior cavity 44 having a longitudinal extent that generally defines the range of variable lift for the engine valve control system, taking into account the size of the exhaust port 64, i.e., the port 64 can be partially covered as the exhaust member 54 moves downwardly relative to the cavity 44.

The piston includes a head 46 disposed in the upper portion 28 of the cylinder and further supported by an exhaust member 54. The head has an outer diameter dimensioned to mate with the inner diameter of the upper portion 28 and the exhaust member 54. The piston 34 further includes a push rod 48 extending from the bottom side 38 thereof. The piston push rod 48 is connected to an engine valve stem 82. In one embodiment, the push rod 48 and valve stem 82 are integrally formed. The engine valve 80 further includes an engine valve head 84 connected to an end of the valve stem 82. In a preferred embodiment, a return spring 50 is disposed between a bottom wall 52 of the cylinder 32 and the piston 34, and biases the piston 34 in an upward direction. The return spring 50 can be positioned inside the cylinder, as shown in FIG. 1, or outside the cylinder, configured as a conventional engine valve return spring, depending on the package needs and/or restrictions.

An exhaust member 54 is disposed in the lower portion 30 of the cylinder. In a first preferred embodiment, the exhaust member 54 is configured as a cylindrical exhaust sleeve having a top and bottom end 56, 58 and an inner and outer surface defined by an inner and outer diameter respectively. The inner diameter is dimensioned to mate with the outer diameter of the piston head as the exhaust sleeve 54 is disposed around the piston head 46. The outer diameter of exhaust sleeve is dimensioned to mate with the inner diameter of the lower portion 30 of the cylinder. The exhaust sleeve 54 moves longitudinally along the longitudinal axis 40 within the lower portion 30 of the cylinder. The exhaust sleeve 54 includes an exhaust port 64 extending from the inner to the outer surface 15 60, 62 thereof. The exhaust sleeve exhaust port 64 communicates with the cavity 44 of the housing exhaust port 42, and maintains that communication as the exhaust sleeve moves from and between a maximum lift position to a minimum lift position. In one preferred embodiment, a spring 66 is disposed between the bottom wall 52 of the cylinder and the bottom end 58 of the exhaust sleeve, and biases the exhaust sleeve 54 in an upward direction.

Also in a first preferred embodiment, an inlet port 68 is formed in the housing 26 and communicates with an upper cavity 70 formed in the lower portion of the cylinder above the exhaust sleeve 54. In particular, the cavity 70 is defined by the outer sidewall surface of the piston head, the top 56 of the exhaust sleeve and the sidewall surface of the cylinder, and is separated from the remainder of the lower portion 30 of the cylinder. The inlet port 68 is connected to the electrohydraulic pressure regulator 12, which provides the control pressure Pc. In this way, a control pressure P3 can be applied to the top end 56 of the exhaust sleeve. The inlet port 68 has a cross-sectional area or diameter that is preferably substantially smaller than the cross-sectional area or diameter of the ports 24 and 42. Likewise, the aspect ratio, defined as the length/diameter of the port, is preferably smaller for the port 68 than the other ports. Of course, it should be understood that the diameter and aspect ratio of the port 68 could be the same as the other ports, and that all of the ports can have different diameters or cross-sections and aspect ratios tailored to a specific design criteria. By preferably having an inlet port 68 with a smaller diameter, which provides substantial flow restriction or damping, the position of the exhaust member 54 is more dynamically stable.

In operation, the solenoid valve 20 is initially turned off, as shown in FIG. 1, such that the piston 34 is positioned at the top of the cylinder 32 with a force applied by the return spring 50. In this position, the engine valve 80 is seated on the engine valve seat (not shown). At the same time, the back pressure Pexh is extended through the inlet port 24 and the exhaust port 42.

Next, the solenoid valve is energized, such that the pressure P1 applied to the top 36 of the piston in the upper portion 28 of the cylinder is about the same as the system pressure Ps, while the bottom pressure P2 applied to the bottom 38 of the piston in the lower portion 30 of the cylinder is substantially equal to the back pressure Pexh. The system pressure is greater than the back pressure, such that the differential pressure force (in addition to a certain amount of differential area, depending on the size of the piston rod) overcomes the biasing force of the return spring 50 and pushes the piston 34 downward in the cylinder 32.

The position of the exhaust sleeve 54 is operably connected to or controlled by a control system, which is comprised of the control pressure circuit and the control spring 66. In particular, the exhaust sleeve 54 is balanced between the pressure P3 applied to the top 56 of the exhaust sleeve and a combination of a bottom pressure P2 and biasing force of the control spring 66 applied to the bottom end 58 of the exhaust sleeve. The control pressure Pc can be either equal/related to or independent of system pressure Ps, depending on the system design and/or control strategy. The position of the exhaust sleeve 54 is relatively stable during substantially the entirety of the piston travel. The response time requirement for the lift change (and thus Pc regulation) is not as stringent as that for the engine valve timing. As such the user can effect a change in the lift over several engine combustion cycles. In this way, the engine valve lift is de-coupled from the timing operation.

To effect a change in lift, the control pressure Pc is altered by manipulating the pressure regulator 12 so as to move the exhaust sleeve 54 in an up or down direction against the force applied by the control spring 66 and the bottom pressure P2. For example, the exhaust sleeve 54 can be moved to a lowermost position in the cylinder 32, where the exhaust port 64 is in communication with the bottom of the exhaust port cavity 44, as shown in FIG. 1. It should be understood that the exhaust sleeve 54 could be moved even slightly lower to a lowermost position as the exhaust port 64 is partially closed by the cylinder wall. In this position, the lift position of the engine valve 80 is maximized. Conversely, the exhaust sleeve 54 can be moved to an uppermost position in the cylinder 32, where the lift position of the engine valve is minimized, and where the exhaust port 64 is in communication with the top of the exhaust port cavity 44, again with the port 64 capable of being partially closed. Of course, one of skill in the art will understand that the control pressure can be continuously, variably controlled so as to allow the exhaust sleeve, with its exhaust port, to be continuously, variably positioned at any desired position between the maximum and minimum lift positions. It should be understood that the term "between" as used in this context means both intermediate and including, such that the desired position can be at either of the maximum and minimum positions, or at any position within that range.

As the piston 34 moves downwardly under the system pressure Ps, the piston head 46 begins to close off the exhaust sleeve exhaust port 64, so as to thereby slow and eventually stop the flow of hydraulic fluid between the lower portion 30 of the cylinder beneath the bottom 38 of the piston and the housing exhaust port 42. As a result, the bottom pressure P2 begins to rise and, with the help from the return spring 50, slows and eventually stops the downward movement of the piston 34. The total travel of the piston (and the engine valve lift) is thus controlled by the position of the exhaust sleeve 54. At the same time, the rising bottom pressure P2 alters the balance of forces on the exhaust sleeve 54 and pushes the exhaust sleeve 54 upwards slightly, thereby helping to close off of the exhaust flow through the exhaust sleeve exhaust port 64. Because of the restrictive or damping nature of the inlet port 68, the exhaust sleeve 54 will not move up too fast, or substantially away from its steady state position, during a brief holding period that follows. Although the inlet port 68 restricts a large transient flow during the brief holding phase, the inlet port 68 is much less restrictive to a small flow needed to return the exhaust sleeve 54 to its steady state position over the rest of a combustion cycle or gradually move the sleeve to a new steady state position or lift position over several combustion cycles as the control pressure Pc is altered.

During the holding period, in which the solenoid valve 20 is kept on, leakage through the clearances between the exhaust sleeve 54, cylinder 32 and piston 34, and a small flow through the inlet port 64, will cause slight pressure changes and piston creeping. With a proper clearance and port design/control, the creeping effect during the very short holding time period is negligible. Alternatively, dynamic seals can be used to reduce the leakage.

After the brief holding period, the solenoid valve 20 is de-energized. At that time, the top pressure P1 drops to Pexh, and the return spring 50 biases the piston 34 to the top of the cylinder as the valve 80 is seated. The previously pressurized fluid in the upper portion 28 of the cylinder above the piston 34 aids in the replenishment of the exhaust circuit and its accumulator (if used), and assists with a speedy filling of the lower portion 30 of the cylinder beneath the piston.

One of skill in the art will understand that the illustrated 3-way solenoid valve 20 can be replaced with a 4-way solenoid valve, so that the piston can be returned hydraulically. Such a design change is simply a matter of sizing, packaging and energy calculation.

Figure 2:
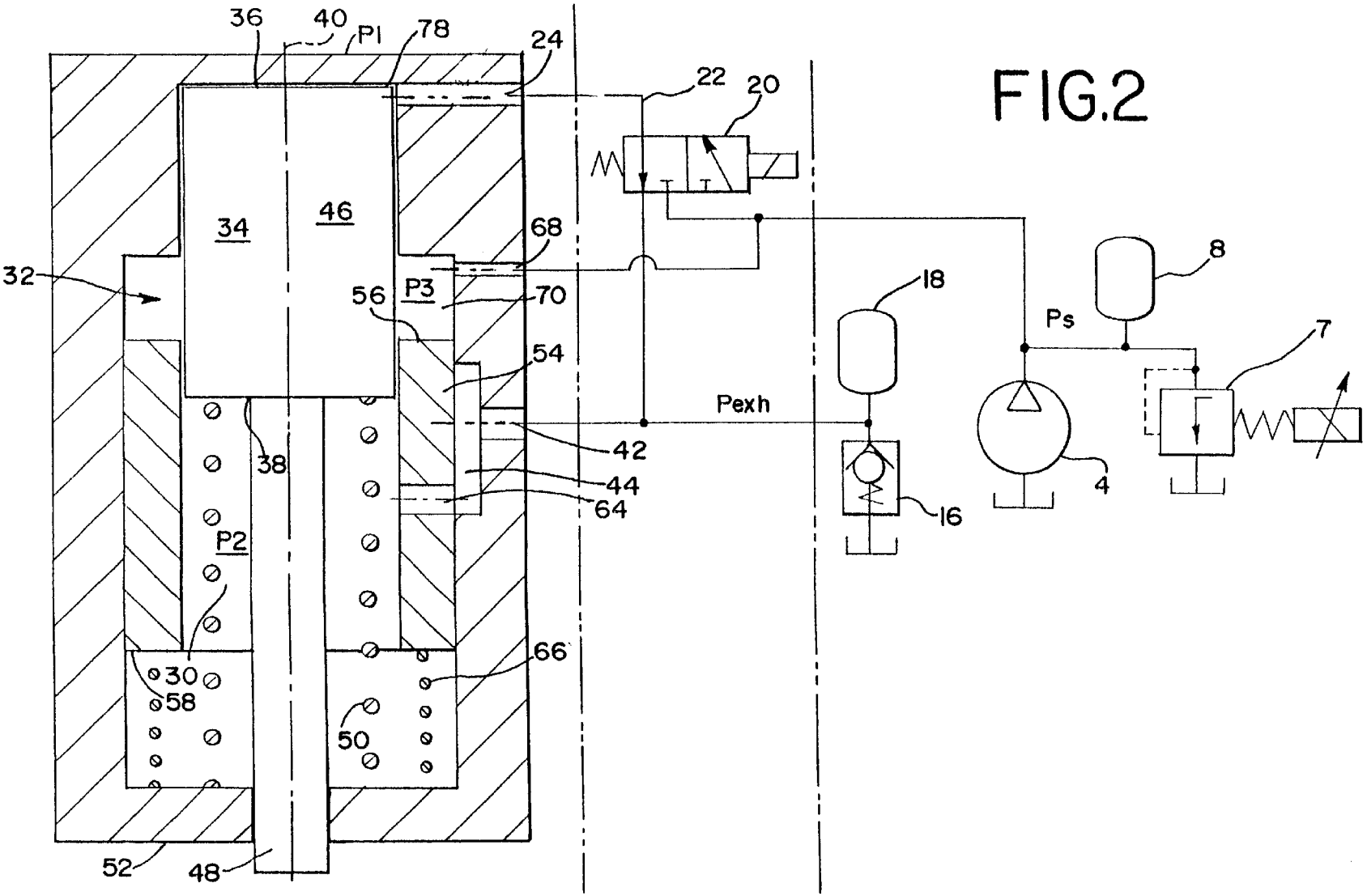
FIG. 2 is a schematic illustration of an alternative preferred embodiment of the engine valve control system.

A second preferred embodiment of the engine valve control system is shown in FIG. 2. The hydraulic actuator 5 is identical to the actuator embodiment shown in FIG. 1. However, the inlet control port 68 is connected to the system supply line under the system pressure Ps. The control pressure line under pressure Pc and the associated pressure regulating valve 12 in the FIG. 1 embodiment is thereby eliminated. However, the system pressure Ps has to be regulated actively preferably by an electrohydraulic pressure regulator 7 to vary the position of the exhaust sleeve 54 and thus the engine valve lift. The same reference numbers used in FIG. 1 have been used to identify like components and features shown in FIG. 2.

During the valve opening sequence, the pressure P1 and the resultant driving force applied to the top 36 of the piston 34 change with the system pressure Ps and thus the engine valve lift setting. As the lift decreases, the piston travels less during a desired opening time period, and a weaker force and acceleration on the piston resulting from a drop in the system pressure Ps may be acceptable. However, a minimum value of system pressure Ps is maintained to overcome the engine cylinder pressure on the engine valve 80 (shown in FIGS. 1 and 8–11) and the force of the return spring 50 and provide enough acceleration for the engine valve to travel through its minimum lift within a desired time period. This minimum pressure Ps values is strongly correlated to the pre-load of the control spring 66. In this way, the embodiment shown in FIG. 2 uses fewer pressure regulators relative to the embodiment shown in FIG. 1. The pump 4 can be a variable-displacement or any servo-hydraulic pump that supplies a variable flow at a desired, adjustable pressure.

Figure 3:
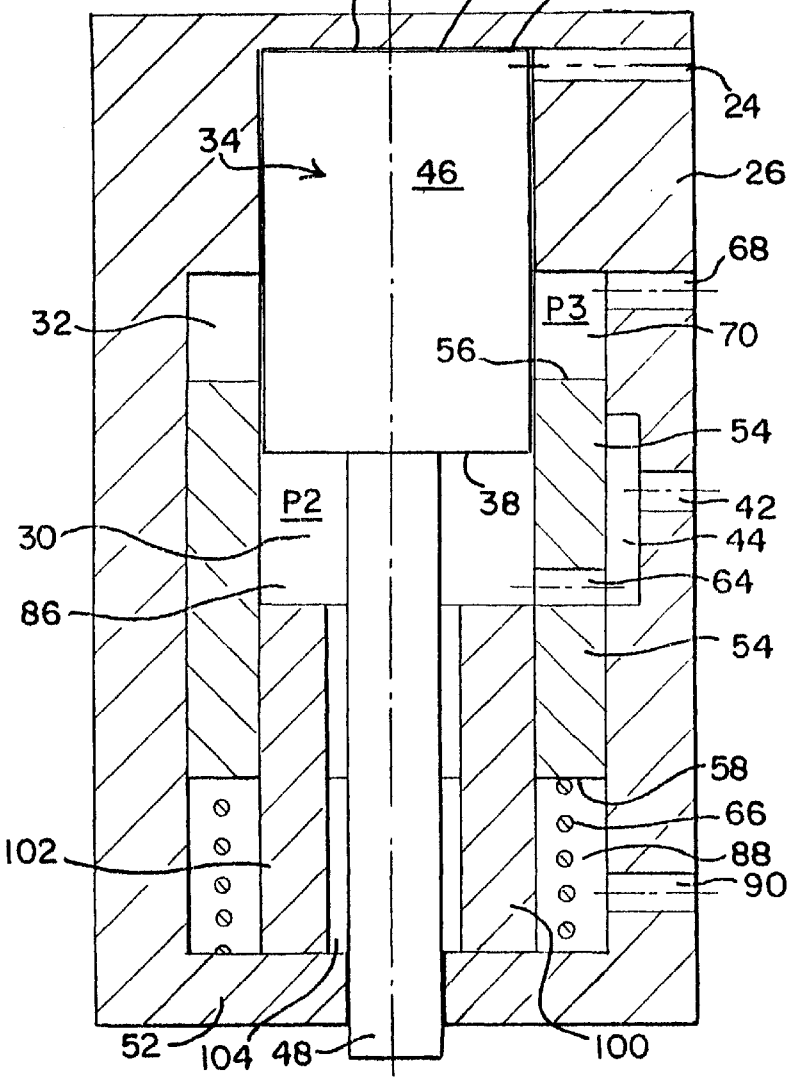
FIG. 3 is a schematic illustration of an alternative preferred embodiment of the engine valve control system.

A third preferred embodiment of the engine valve control system, and in particular a housing 26, piston 34 and exhaust member 54 configuration, is shown in FIG. 3. The hydraulic circuit used in this preferred embodiment is substantially the same as the hydraulic circuit described above in connection with the embodiment shown in FIG. 1, and has not been shown for the sake of simplicity. The same reference numbers used in FIG. 1 have been used to identify like components and features shown in FIG. 3.

The third preferred embodiment differs from the first preferred embodiment in that it includes an additional isolation sleeve 100 disposed in the lower portion 30 of the cylinder. The isolation sleeve 100 has an outer surface 102 having an outer diameter dimensioned to be received in the inner diameter of the exhaust sleeve 54. The isolation sleeve 100 is dispose concentrically within the exhaust sleeve 54 beneath the bottom 38 of the piston. The isolation sleeve 100 has a bore 104 passing longitudinally therethrough, with the piston push rod 48 and/or valve stem 82 passing therethrough. The isolation sleeve 100 divides the lower portion 30 of the cylinder into a first cavity 86 communicating with a bottom 38 of the piston and a second cavity 88 communicating with a bottom end 58 of the exhaust sleeve. The cylinder further includes an exhaust port 90 communicating with the second cavity 88 formed beneath the exhaust sleeve 54. Due to the positioning of the isolation sleeve 100, the return spring (not shown) preferably is located outside the cylinder.

In operation, the bottom end 58 of the exhaust sleeve 54 is isolated from the pressure P2 applied to the bottom side 38 of the piston. Instead, the cavity 88 beneath the bottom end 58 of the exhaust sleeve is exhausted. As such the exhaust sleeve 54 does not move upward when P2 is pressurized as the flow through the exit port 64 is blocked by the piston 34. In this way, the position of the exhaust sleeve 54 can be precisely controlled at all times during the cycle of the engine valve. In addition, the inlet port 68 in this embodiment is preferably shown as having a similar cross-sectional area or aspect ratio as the other ports 24 and 42, since it does not need to be substantially restrictive to transient flows. Of course, one should understand that the size or aspect of the port can be reduced or increased relative to the other ports as set forth above.

Figure 4:
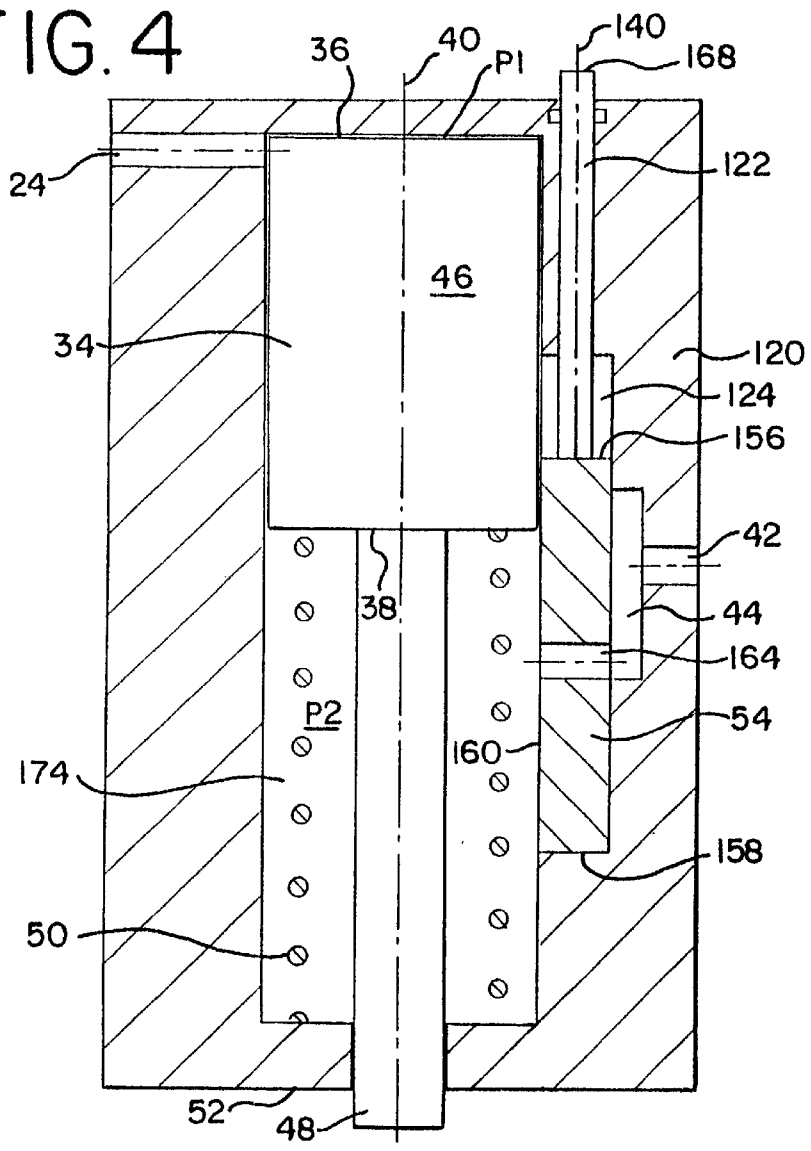
FIG. 4 is a schematic illustration of an alternative preferred embodiment of the engine valve control system.

A fourth preferred embodiment of the engine valve control system, and in particular a housing 120 , piston 34 and exhaust member 154 configuration, is shown in FIG. 4. The hydraulic circuit used in this preferred embodiment is substantially the same as the hydraulic circuit described above in connection with the embodiment shown in FIG. 1, and has not been shown again for sake of simplicity. The same reference numbers used in FIG. 1 have been used to identify like components and features shown in FIG. 4.

As shown in FIG. 4, the exhaust member 154 is configured as an exhaust wedge, which does not extend around the piston as does the exhaust sleeve. Rather, the housing 120 includes a longitudinally extending cavity 124 formed along a portion of the sidewall of the cylinder 174 and communicating therewith. The exhaust wedge 154 has an inner surface 160 shaped to matingly abut the piston sidewall.

In operation, the exhaust wedge 154 slides up and down within the cavity 124 in a longitudinal direction along a longitudinal axis 40. The exhaust wedge 154 includes an exhaust port 164 that communicates with the housing exhaust port 42 and in particular the cavity 44. The exhaust sleeve can be moved to a lowermost position in the cavity 124, where the exhaust port 164 is in communication with the bottom of the exhaust port cavity 44. In this position, the lift position of the valve engine 80 is maximized. Conversely, the exhaust wedge 154 can be moved to an uppermost position in the cavity 124, where the exhaust port 164 is in communication with the top of the exhaust port cavity 44. In this position, the lift position of the valve engine is minimized.

The control system for the exhaust wedge preferably includes a control rod 122 extending from a top end 156 of the exhaust wedge 154 and a motion control mechanism 168, which is attached to the control rod. One of skill in the art will understand that motion control mechanism can be any kind of mechanical, electrical, hydraulic, etc. control mechanism, or any combination thereof. A single motion control mechanism can be used to control a single engine valve, a pair of engine valves (either intake or exhaust), all of the engine valves on a cylinder, certain types of engine valves used in the entire engine, or any other conceivable arrangement. For example, a step-motor can be used to control the lift of all of the intake engine valves, and another step-motor can be used to control the lift of all of the exhaust engine valves. The fourth preferred embodiment does not have an inlet control port 68, or require a control pressure Pc. It should be understood that a similar motion control mechanism, or a plurality thereof, could also be used to control the motion of the exhaust sleeve, although such a sleeve, when actuated at a single point, may have a tendency to jam within the cylinder.

Figure 5:
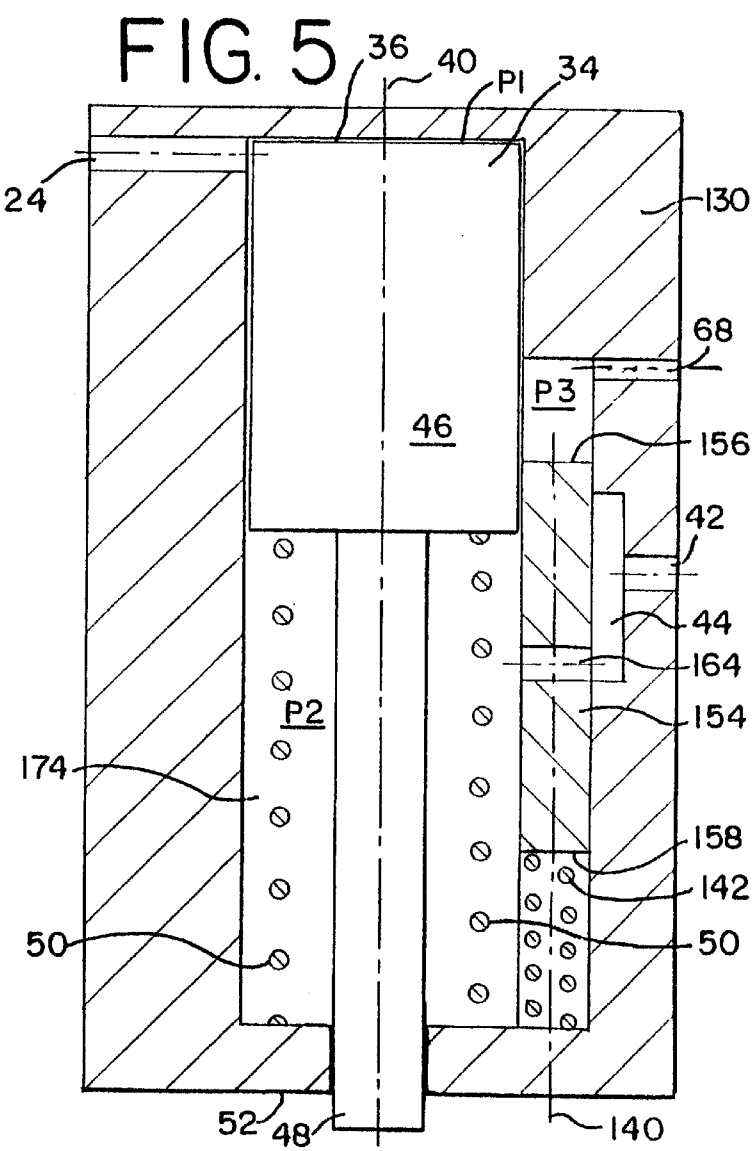
FIG. 5 is a schematic illustration of an alternative preferred embodiment of the engine valve control system.

A fifth preferred embodiment of the engine valve control system, and in particular a housing 130, piston 34 and exhaust member 154 configuration, is shown in FIG. 5. The hydraulic circuit used in this preferred embodiment is substantially the same as the hydraulic circuit described above in connection with the embodiment shown in FIG. 1, and has not been shown again for sake of simplicity. The same reference numbers used in FIGS. 1 and 4 have been used to identify like components and features shown in FIG. 5.

In the fifth preferred embodiment, the exhaust wedge control system includes a pressure P3 which is applied to a top end 156 of the exhaust wedge, and a control spring 142, which engages a bottom end 158 of the exhaust wedge. The operation of the fifth preferred embodiment is substantially the same as the first preferred embodiment. If desired, an isolation sleeve 100, as illustrated in the second preferred embodiment, can be disposed in the bottom of the cylinder so as to create an isolated cavity with an exhaust port communicating therewith. In such an embodiment, the bottom of the exhaust wedge would be prevented from being exposed to the transient high pressure P2.

Figure 6:
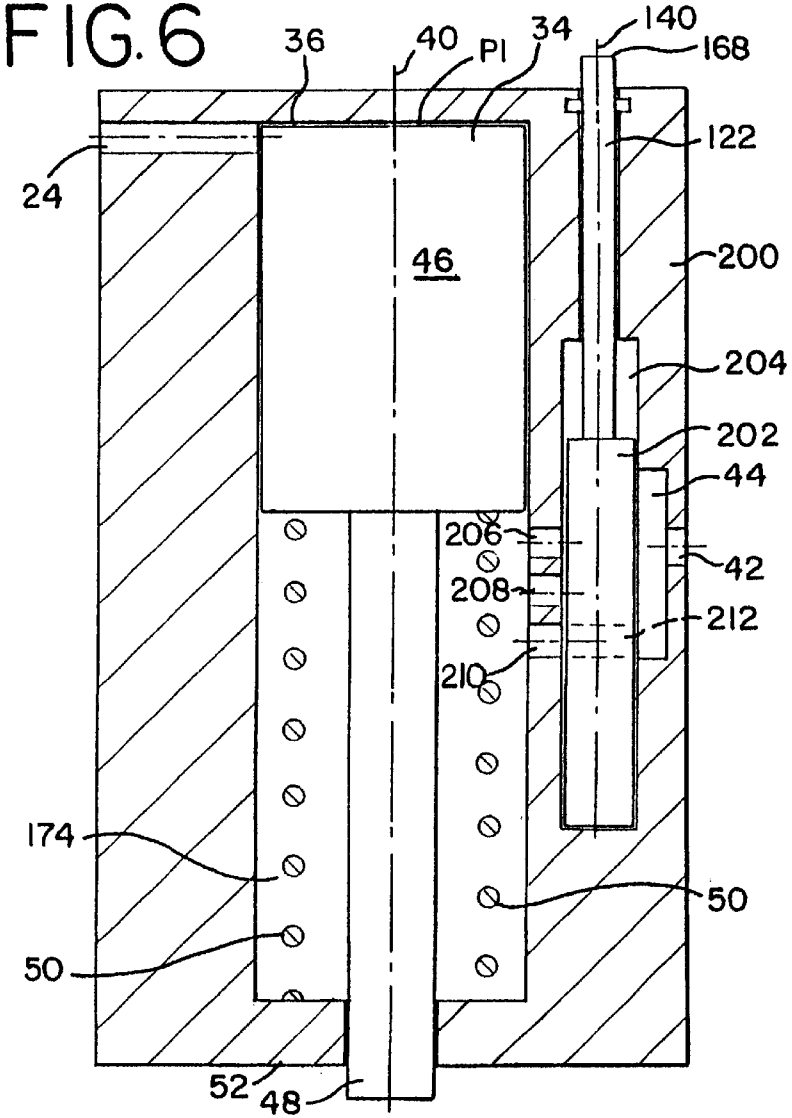
FIG. 6 is a schematic illustration of an alternative preferred embodiment of the engine valve control system.

A sixth preferred embodiment of the engine valve control system, and in particular a housing 200, piston 34 and exhaust member 202 configuration, is shown in FIG. 6. The hydraulic circuit used in this preferred embodiment is substantially the same as the hydraulic circuit described above in connection with the embodiment shown in FIG. 1, and has not been shown again for sake of simplicity. The same reference numbers used in FIGS. 1 have been used to identify like components and features shown in FIG. 6.

In this preferred embodiment, the housing exhaust port 44 includes a primary exhaust port, having a cavity 44, and a plurality of longitudinally spaced secondary exhaust ports 206, 208, 210 (shown as three). It should be understood that the number of secondary exhaust ports can be altered as desired to provide various discrete lift positions, and that the number three is meant to be exemplary rather than limiting. The secondary exhaust ports 206, 208, 210 communicate with the cylinder 174. The housing 200 further includes a longitudinally extending cavity 204 formed between the primary and secondary exhaust ports. An exhaust member 202, configured as an exhaust piston, is disposed in the cavity 204. The exhaust piston 202 has an exhaust port 212 therethrough, with the exhaust piston exhaust port 212 always maintained in communication with the primary exhaust port cavity 44.

In operation, a control system moves the exhaust piston 202 within the cavity 204 along the longitudinal axis 140 and selectively brings the exhaust piston exhaust port 212 into communication with one of the secondary exhaust ports 206, 208, 210. By controlling the alignment between the exhaust port 212 in the exhaust piston 202 and the secondary exhaust ports 206, 208, 210, the travel of the piston 34 is controlled. In this embodiment, the lift variation is discrete, not continuous. Although discrete lift variation is not as flexible as continuous lift variation, position of the piston 34 can be precisely controlled with digital controls. Moreover, the number and position of the secondary exhaust ports can be designed to provide substantially the same performance as a continuous lift control under certain operating conditions.

When the desired position of the exhaust piston exhaust port 212 is in communication with the uppermost 206 of the plurality of secondary exhaust ports, the lift of the engine valve is minimized. Conversely, when the desired position of the exhaust piston exhaust port 212 is in communication with the lowermost 210 of the plurality of secondary exhaust ports, the lift of the engine valve is maximized. Of course, the exhaust pin exhaust port 212 can be placed in communication with the intermediate secondary exhaust port 208 so as to achieve an intermediate lift position.

As with the exhaust wedge described above in connection with the fourth preferred embodiment, the exhaust piston 202 is preferably mechanically controlled by a control rod 122, which is connected to a motion control mechanism 168. If necessary for a smoother exhaust piston 202 movement, the cavity 204 at the top and bottom of the exhaust piston may be exhausted to a tank to prevent pressurization and/or cavitation of the trapped fluid.

Figure 7:
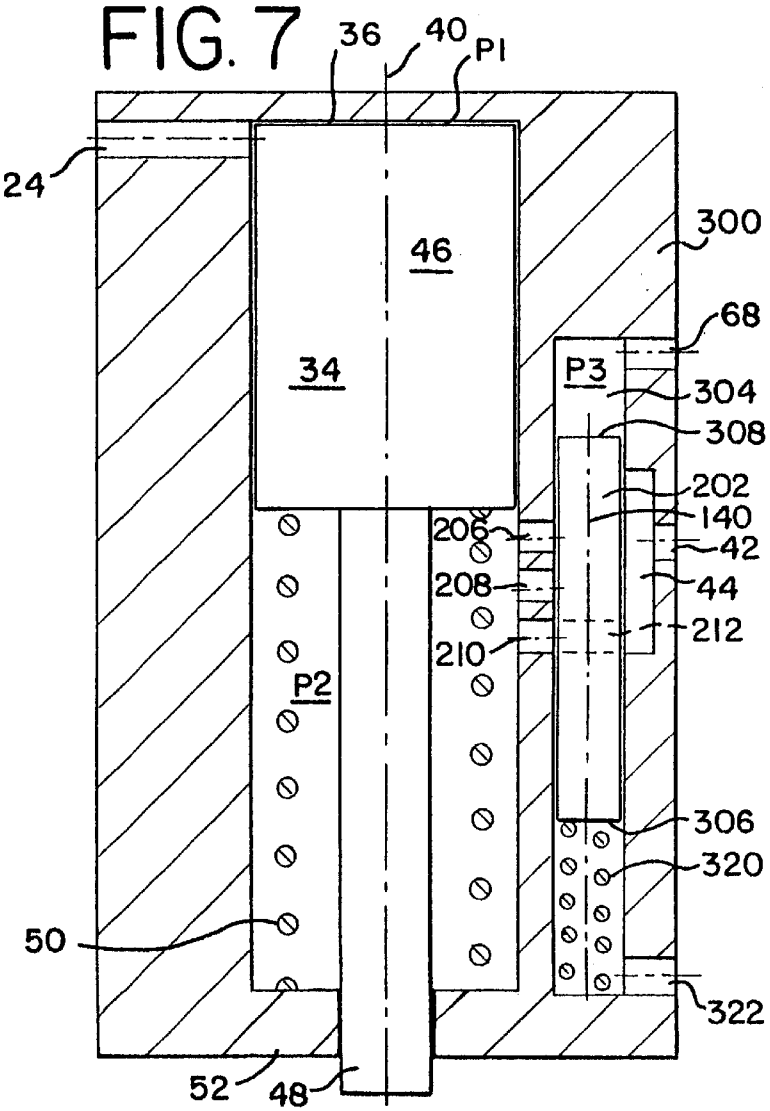
FIG. 7 is a schematic illustration of an alternative preferred embodiment of the engine valve control system.

A seventh preferred embodiment of the engine valve control system, and in particular a housing 300, piston 34 and exhaust member 202 configuration, is shown in FIG. 7. The hydraulic circuit used in this preferred embodiment is substantially the same as the hydraulic circuit described above in connection with the embodiment shown in FIG. 1, and has not been shown again for the sake of simplicity. The same reference numbers used in FIGS. 1 and 6 have been used to identify like components and features shown in FIG. 7.

In this embodiment, a control spring 320 is disposed in a cavity 304 formed in the housing 300 and engages a bottom end 306 of the exhaust piston 202. In addition, an inlet port 68 communicates with the top 308 of the exhaust piston 202. As such, the control system includes the control spring 320 and the control pressure Pc. As explained with the sixth embodiment, the engine valve control system provides discrete lift variation.

FIGS. 8–11 shown various alternative arrangements for operably connecting the engine valve 80 with the piston 34. In this context, the phrase "operably connected" means interfaced, engaged, or coupled with for at least a portion of the opening cycle, such that the movement of the piston moves the engine valve in the first direction. In the embodiment shown in FIG. 8, the push rod 210 abuttingly engages, but is not fixed to, an end 214 of the valve stem 212 so as to be operably connected thereto. The valve stem 212 includes a laterally extending flange member 216. A return spring 218 is disposed between the housing 220 and the flange member 216 and biases the engine valve upwardly against the piston push rod 210 so as to seat the engine valve. During the opening cycle, the end of the push rod 222 engages, or is operably connected to, the end 214 of the valve stem and pushes the engine valve off of the seat 224. The piston push rod and valve stem are not fixedly connected, but rather have a free-floating interface.

Figures 8, 9, 10, 11:
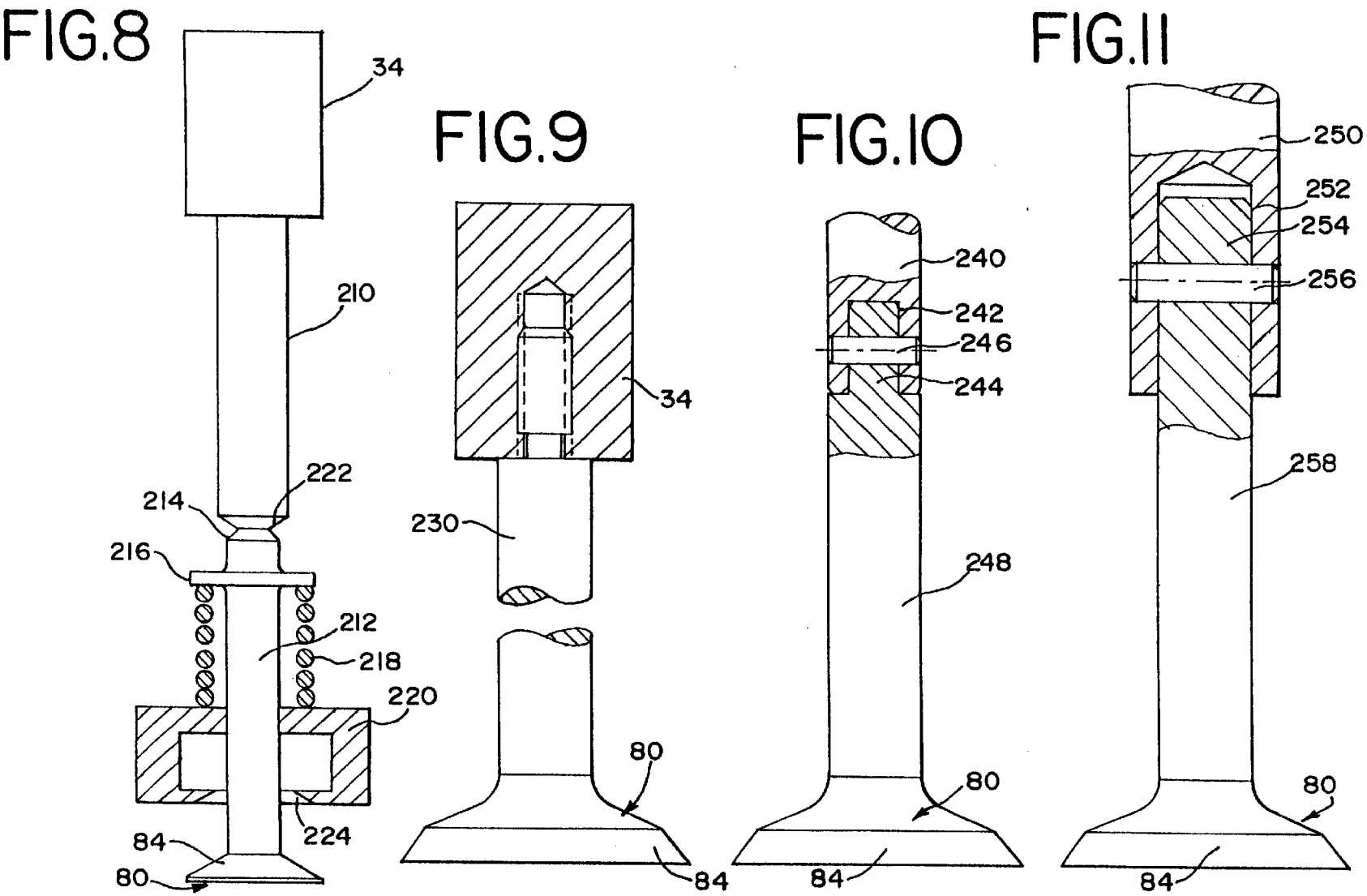
FIG. 8 is a partial cross-sectional view of an alternative embodiment of an engine valve connected to a piston.
FIG. 9 is a partial cross-sectional view of an alternative embodiment of an engine valve connected to a piston.
FIG. 10 is a partial cross-sectional view of an alternative embodiment of an engine valve connected to a piston.
FIG. 11 is a partial cross-sectional view of an alternative embodiment of an engine valve connected to a piston.

In the embodiment shown in FIG. 9, the engine valve stem and push rod are integrally formed as a single shaft 230, with an end of the shaft preferably being threadably engaged with the piston 34.

Alternatively, as shown in FIG. 10, the push rod 240 includes an opening or recess 242 dimensioned to receive an insert portion 244 of the valve stem 248. Of course, it should be understood that the recess could be formed on the valve stem, with the insert portion formed on the push rod. A pin 246 extends through aligned openings formed in each of the push rod 240 and valve stem 248 so as to operably connect the engine valve and piston.

In yet another embodiment, shown in FIG. 11, the push rod 250 has a larger diameter than the engine valve stem 258. In this embodiment, the end 254 of the valve stem is received in an opening 252, or recess, formed in the end of the push rod. Again, a pin 256 extends through aligned openings formed in the valve stem and push rod and connects the engine valve and piston. One of skill in the art will understand that other alternative embodiments of operably connecting the engine valve and piston can be used without departing from the scope or spirit of this invention, and that the preceding embodiments are meant to be illustrative rather than limiting.

The engine valve control system embodiments herein described do not require lift sensing and feedback. Rather, they are an open loop control. As such, there is no need for position sensors, complex control algorithm, and complicated electronic driver circuits. Instead, the accuracy of the lift is dependent on the ability to control, and the accuracy thereof, the control pressure Pc and the control spring. One of skill in the art will understand that in addition to the port throttling effected through the inlet and exhaust ports, various hydraulic cushion mechanisms commonly used in hydraulic cylinders can also be employed.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An engine valve control system for an internal combustion engine comprising:

a housing comprising a cylinder defining a longitudinal axis, said housing having an exhaust port;

a piston disposed in said cylinder and moveable along said longitudinal axis in a first and second direction, said piston having a first and second side;

an engine valve operably connected to said first side of said piston;

an exhaust member disposed in said housing and variably moveable along a longitudinal path to a desired position between a maximum and minimum lift position, wherein said exhaust member has an exhaust port maintaining communication with said housing exhaust port as said exhaust member is variably moved to said desired position between said maximum and minimum lift positions;

a pressure source applying a pressure to said second side of said piston as said piston is moved in said first direction;

a control system operably connected to said exhaust member, said control system moving said exhaust member to said desired position; and wherein said piston is moveable along said longitudinal axis in said first direction from a seated position to a lift position, wherein said exhaust member exhaust port is unblocked by said piston when said piston is in said seated position and wherein said piston blocks said exhaust member exhaust port when said piston is in said lift position.

2. The invention of claim 1 wherein said exhaust member comprises a sleeve member disposed around said piston.

3. The invention of claim 2 wherein said exhaust sleeve has a first and second end and wherein said cylinder comprises a first portion having a first diameter dimensioned to receive said piston and a second portion having a second diameter dimensioned to receive said exhaust sleeve, wherein said exhaust sleeve has an inner diameter dimensioned to receive said piston, and further comprising a isolation sleeve disposed concentrically within said exhaust sleeve adjacent said first side of said piston, wherein said isolation sleeve divides said second portion of said cylinder into a first cavity communicating with said first side of said piston, and a second cavity communicating with said first end of said exhaust sleeve.

4. The invention of claim 3 wherein said housing further comprises a second exhaust port communicating with said second cavity.

5. The invention of claim 1 wherein said housing comprises a cavity communicating with said cylinder, and wherein said exhaust member comprises a wedge member moveably disposed in said cavity, wherein said piston slideably abuts said wedge member.

6. The invention of claim 1 wherein said housing exhaust port comprises an primary exhaust port and said housing further comprises a plurality of longitudinally spaced secondary exhaust ports communicating with said cylinder, wherein said housing further comprises a cavity formed between and communicating with said primary and said secondary exhaust ports, and wherein said exhaust member comprises an exhaust piston disposed in said cavity, wherein said exhaust piston is moveable along said longitudinal axis such that said exhaust piston exhaust port is selectively brought into communication with one of said secondary exhaust ports of said housing.

7. The invention of claim 1 wherein said control system comprises a spring engaged with said exhaust member.

8. The invention of claim 1 wherein said control system comprises a hydraulic pressure applied to said exhaust member.

9. The invention of claim 8 wherein said control system further comprises a spring engaged with said exhaust member.

10. The invention of claim 8 wherein said housing has a cavity housing said exhaust member and further comprising an inlet port communicating with said cavity.

11. The invention of claim 8 wherein said control system further comprises an electrohydraulic valve operably applying said hydraulic pressure.

12. The invention of claim 8 wherein said housing further comprises an inlet port, wherein said hydraulic pressure is applied through said inlet port.

13. The invention of claim 12 wherein said inlet port comprises a first inlet port, and wherein said housing further comprises a second inlet port, wherein said pressure applied to said second side of said piston is applied through said second inlet port.

14. The invention of claim 13 wherein said first inlet port has a smaller cross-sectional flow area than said second inlet port.

15. The invention of claim 1 wherein said control system comprises a motion control mechanism.

16. The invention of claim 1 wherein said housing further comprises an inlet port communicating with said cylinder adjacent said second side of said piston, wherein said pressure applied to said second side of said piston is applied through said inlet port.

17. The invention of claim 1 further comprising a spring biasing said piston.

18. A method for controlling an engine valve in an internal combustion engine comprising:

providing a housing comprising a cylinder defining a longitudinal axis, said housing having an exhaust port; a piston disposed in said cylinder and moveable along said longitudinal axis in a first and second direction, said piston having a first and second side; said engine valve operably connected to said first side of said piston; an exhaust member disposed in said housing and variably moveable along said longitudinal axis; and a control system operably connected to said exhaust member;

applying a force to said exhaust member with said control system;

moving said exhaust member along a longitudinal path in response to said applying said force with said control system;

maintaining communication between said exhaust member exhaust port and said housing exhaust port as said exhaust member is moved along said longitudinal axis;

applying a pressure to said second side of said piston and thereby moving said piston from a seated position in said first direction along said longitudinal axis wherein said exhaust port is not blocked;

moving said engine valve with said piston; and blocking said exhaust member exhaust port with said piston as said piston moves in said first direction to a lift position.

19. The invention of claim 18 wherein said exhaust member comprises a sleeve member disposed around said piston.

20. The invention of claim 18 wherein said housing comprises a cavity communicating with said cylinder, and wherein said exhaust member comprises a wedge member moveably disposed in said cavity, wherein said piston slideably abuts said wedge member.

21. The invention of claim 18 wherein said housing exhaust port comprises an primary exhaust port and said housing further comprises a plurality of longitudinally spaced secondary exhaust ports communicating with said cylinder, wherein said housing further comprises a cavity formed between and communicating with said primary and said secondary exhaust ports, and wherein said exhaust member comprises an exhaust piston disposed in said cavity, wherein said moving said exhaust member comprises moving said exhaust piston along said longitudinal axis such that said piston exhaust port is selectively brought into communication with one of said secondary exhaust ports of said housing.

22. The invention of claim 18 wherein said control system comprises a spring engaged with said exhaust member, and wherein said applying said force to said exhaust member with said control system comprises biasing said exhaust member with said spring.

23. The invention of claim 18 wherein said applying said force to said exhaust member with said control system comprises applying a hydraulic pressure to said exhaust member.

24. The invention of claim 23 wherein said control system comprises a spring engaged with said exhaust member, and wherein said applying said force to said exhaust member with said control system further comprises biasing said exhaust member with said spring.

25. The invention of claim 23 wherein said housing has a cavity housing said exhaust member and further comprising an inlet port communicating with said cavity, wherein said applying said hydraulic pressure to said exhaust member comprises flowing a hydraulic fluid into said cavity through said inlet port.

26. The invention of claim 23 wherein said control system further comprises an electrohydraulic valve, and wherein said applying said hydraulic pressure comprises activating said electrohydraulic valve.

27. The invention of claim 23 wherein said housing further comprises an inlet port, wherein said applying said hydraulic pressure comprises applying said hydraulic pressure through said inlet port.

28. The invention of claim 27 wherein said inlet port comprises a first inlet port, and wherein said housing further comprises a second inlet port, wherein said applying said pressure to said second side of said piston comprises applying said pressure through said second inlet port.

29. The invention of claim 28 wherein said first inlet port has a smaller cross-sectional flow area than said second inlet port.

30. The invention of claim 18 wherein said control system comprises a motion control mechanism, and wherein said applying said force to said exhaust member with said control system comprises moving said exhaust member with said motion control mechanism.

31. The invention of claim 18 wherein said exhaust member has a first and second end, and wherein said cylinder comprises a first portion having a first diameter dimensioned to receive said piston and a second portion having a second diameter dimensioned to receive said exhaust sleeve, wherein said exhaust sleeve has an inner diameter dimensioned to receive said piston, and further comprising an isolation sleeve disposed concentrically within said exhaust sleeve adjacent said first side of said piston, wherein said isolation sleeve divides said second portion of said cylinder into a first cavity communicating with said first side of said piston, and a second cavity communicating with said first end of said exhaust sleeve.

32. The invention of claim 31 wherein said housing further comprises a second exhaust port communicating with said second cavity.

33. The invention of claim 18 wherein said housing further comprises an inlet port communicating with said cylinder adjacent said second side of said piston.

34. An engine valve control system for an internal combustion engine comprising:

a housing comprising a cylinder defining a longitudinal axis, said housing having an exhaust port and first and second inlet ports, wherein said first inlet port has a smaller cross-sectional flow area than said exhaust port and said second inlet port;

a piston disposed in said cylinder and moveable along said longitudinal axis in a first and second direction, said piston having a first and second side;

an engine valve operably connected to said first side of said piston;

an exhaust member disposed in said housing and variably moveable along a longitudinal path to a desired position between a maximum and minimum lift position, wherein said exhaust member has an exhaust port maintaining communication with said housing exhaust port as said exhaust member is variably moved to said desired position between said maximum and minimum lift positions;

a pressure source applying a pressure to said second side of said piston through said second inlet port as said piston is moved in said first direction;

a control system operably connected to said exhaust member, said control system moving said exhaust member to said desired position, wherein said control system comprises a hydraulic pressure applied to said exhaust member through said first inlet port; and wherein said piston is moveable along said longitudinal axis in said first direction to a lift position, wherein said piston blocks said exhaust member exhaust port.

35. A method for controlling an engine valve in an internal combustion engine comprising:

providing a housing comprising a cylinder defining a longitudinal axis, said housing having an exhaust port and first and second inlet ports, wherein said first inlet port has a smaller cross-sectional flow area than said exhaust port; a piston disposed in said cylinder and moveable along said longitudinal axis in a first and second direction, said piston having a first and second side; said engine valve operably connected to said first side of said piston; an exhaust member disposed in said housing and variably moveable along said longitudinal axis; and a control system operably connected to said exhaust member;

applying a hydraulic pressure to said exhaust member through said first inlet port with said control system;

moving said exhaust member along a longitudinal path in response to said applying said force with said control system;

maintaining communication between said exhaust member exhaust port and said housing exhaust port as said exhaust member is moved along said longitudinal axis;

applying a pressure to said second side of said piston through said second inlet port and thereby moving s aid piston in said first direction along said longitudinal axis;

moving said engine valve with said piston; and blocking said exhaust member exhaust port with said piston as said piston moves in said first direction.

* * * * *